US010424167B2

(12) United States Patent
Garrison

(10) Patent No.: US 10,424,167 B2
(45) Date of Patent: Sep. 24, 2019

(54) LOTTERY GAME SYSTEM AND METHOD WITH AUGMENTED REALITY SCRATCH-OFF LOTTERY TICKET

(71) Applicant: Scientific Games International, Inc., Newark, DE (US)

(72) Inventor: Scott B. Garrison, Duluth, GA (US)

(73) Assignee: Scientific Games International, Inc., Newark, DE (US)

( * ) Notice: Subject to any disclaimer, the term of this patent is extended or adjusted under 35 U.S.C. 154(b) by 2 days.

(21) Appl. No.: 15/785,528

(22) Filed: Oct. 17, 2017

(65) Prior Publication Data

US 2019/0114871 A1 Apr. 18, 2019

(51) Int. Cl.
*G07F 17/32* (2006.01)

(52) U.S. Cl.
CPC ..... *G07F 17/329* (2013.01); *G07F 17/3218* (2013.01); *G07F 17/3237* (2013.01)

(58) Field of Classification Search
CPC . G07F 17/329; G07F 17/3218; G07F 17/3237
See application file for complete search history.

(56) References Cited

U.S. PATENT DOCUMENTS 8,226,011 B2 7/2012 Merkli et al.
8,517,811 B2 8/2013 Pollard et al.
9,269,219 B2 2/2016 Lyons et al.
9,582,968 B2 * 2/2017 Rosenheimer ..... G07F 17/3211
9,626,807 B2 4/2017 Lyons et al.
2007/0275779 A1 * 11/2007 Amaitis ..... G07F 17/32 463/42
2008/0194323 A1 8/2008 Merkli et al.
2011/0065496 A1 3/2011 Gagner et al.
2011/0105213 A1 * 5/2011 Irwin, Jr. ..... G07F 17/32 463/17
2013/0029744 A1 * 1/2013 Harding ..... G07F 17/3225 463/17
2015/0228148 A1 8/2015 Barnes
2016/0104346 A1 * 4/2016 Ovalle ..... H04W 4/21 463/17
2016/0148464 A1 5/2016 Lahmi
2018/0089927 A1 * 3/2018 Anderson ..... G07F 17/3211

* cited by examiner

*Primary Examiner* — Jason Skaarup
(74) *Attorney, Agent, or Firm* — Dority & Manning, P.A.

(57) ABSTRACT

A method for implementing a virtual and augmented reality scratch-off lottery ticket includes configuring a game server for communication with a player mobile device, the game server receiving real-world location data from the mobile device. A virtual scratch-off lottery ticket is downloaded to the mobile device, wherein the player simulates removal of a scratch-off coating from a plurality of scratch spots on the lottery ticket to reveal underlying game indicia that indicates the outcome of the lottery ticket. Via an application running on the mobile device, the player moves to a geographic location before the simulated removal of the scratch-off coating is enabled on the mobile device. At the geographic location, the game server and running application overlay a virtual objet on a screen image of the location on the mobile device. The application running on the mobile device provides for the player to interact with the virtual object in a manner to acquire the virtual object for later simulated removal of the scratch-off coating from at least one of the scratch spots on the lottery ticket to reveal the underlying game data.

11 Claims, 4 Drawing Sheets

LOTTERY GAME SYSTEM AND METHOD WITH AUGMENTED REALITY SCRATCH-OFF LOTTERY TICKET

BACKGROUND

The lottery or gaming industry is continuously seeking methods to enhance the gaming experience for players, as well as to increase the benefit for participating retail establishments that sell lottery tickets.

Scratch-off lottery tickets are a mainstay of the lottery industry and are quite popular among players. However, the conventional paper-based scratch-off tickets have been in use for decades and the industry is continuously seeking ways to enhance the tickets so as to continue to attract new players. Such enhancements are, however, limited by the very "hard" nature of paper tickets.

In addition, with increased availability and connectivity to the Internet, players are looking to integrate their lottery gaming experience with network-enabled personal mobile devices, such as a smartphone or PDA (personal data assistant). In this regard, various lottery providers or authorities are now providing electronic game tickets wherein the reveal aspect is conducted via the player's smartphone. For example, the New York Lottery has recently introduced a scratch-off lottery ticket game ("Gold Castle") wherein the ticket includes a conventional scratch-off game play area and an optional 3-D game reveal capability. Players can download an application to their smartphone that enables a program to scan a code on the ticket and automatically launch the application, which presents a 3-D view of a castle on the player's smartphone. The player taps windows in the castle, which open to reveal whether the player has won a prize or not.

For many patrons, the purchase of scratch-off lottery tickets at retail establishments, such as gas stations and convenience stores, is secondary to another purchase or reason for visiting the retail establishment. For example, a patron may decide as an afterthought to also buy a lottery ticket once they have stopped at a gas station to purchase fuel. Except in the situation where an extraordinarily high jackpot (e.g. a record Powerball™ jackpot) motivates players to visit the retail establishments for the primary purpose of purchasing lottery tickets, the sale of lottery tickets may not be a significant "driver" of patron traffic to the location. As other methods are implemented for purchase of lottery tickets by players electronically via the Internet (or other remote means), the role of the retail establishments will continue to diminish, as well as the motivation for the retail establishments to act as authorized lottery sales agents.

Virtual or augmented reality location-based video games that are played by applications running on smartphones have also grown in popularity, such as the Pokémon Go™ and Ingress™ games from Niantic. These games have introduced new and exciting experiences to players but, to date, have not been successfully introduced into a lottery gaming environment.

The present invention seeks methods to address the issues discussed above with respect to the conventional retail establishments while also enhancing a player's lottery gaming experience with scratch-off lottery tickets via their mobile device.

SUMMARY

Objects and advantages of the invention will be set forth in part in the following description, or may be obvious from the description, or may be learned through practice of the invention.

In a particular embodiment, the invention provides a method for implementing a virtual and augmented reality scratch-off lottery ticket that can be played by a player via a mobile device, such as a smart phone. In accordance with the method, a game server is configured for communication with the player's mobile device and receives real-world location data from the mobile device, for example from a GPS function enabled with the mobile device. A virtual scratch-off lottery ticket is downloaded from the game server to the mobile device and may have any desired game theme. As with conventional paper scratch-off lottery tickets, for the downloaded virtual version, the player simulates removal of a scratch-off coating from a plurality of scratch spots on the lottery ticket to reveal underlying game indicia that reveals a winning or losing outcome of the lottery ticket. Via an application running on the mobile device, the player is required to move to a geographic location in the real world before the simulated removal of the scratch-off coating is enabled on the mobile device, wherein such movement is detected by the mobile device and verified by the real-world location data transmitted to the game server. For example, once the player initiates start of the virtual lottery ticket, the server must detect that the player (i.e. the mobile device) has moved from one geographic location to another before one or more of the scratch-spots can be revealed to the player. At the geographic location, the game server and running application overlay an augmented reality virtual object ("virtual object") on a screen image of the location presented to the player on their mobile device. The application provides for the player to interact with the virtual object so as to acquire the virtual object for later use in a simulated removal of the scratch-off coating from at least one of the scratch spots on the lottery ticket to reveal the underlying game data.

Eventually, the player will use the virtual object to simulate scratching of the scratch-off coating from one of the scratch-spots on the virtual lottery ticket displayed on their mobile device. This may happen essentially immediately after acquiring the virtual object. Alternately, the virtual object is stored for retrieval by the player at a time of their choosing for use to simulate scratching of the scratch-off coating from one of the scratch-spots on the virtual lottery ticket. If multiple virtual objects must be acquired as a function of the number of scratch-spots, they may all be stored for later use by the player.

In a particular embodiment, the player may be required to move to an additional geographic location and interact with an additional virtual object for each scratch-spot on the lottery ticket. For example, if the lottery ticket has six different scratch-spots, the player may be required to move between six different geographic locations to acquire a virtual tool for each of the scratch-spots. In alternate embodiments, more than one (including all) of the scratch-spots could be revealed with a single virtual tool acquired at a single geographical location.

Play of the virtual lottery tickets may be implemented by the game server such that a minimum distance is required between the geographic locations. It should be appreciated that this minimum distance may vary from a few feet (e.g. less than ten feet) to a much greater distance. The minimum distance may be based at least in part on sensitivity of the real world location data received by the game server from the mobile device. In other words, if the sensitivity of the mobile device's GPS function is a few feet, then the minimum distance could be defined as this minimum sensitivity distance. Thus, in this embodiment, the player could potentially play the entire virtual ticket within the confines of a single room or other relatively small, defined location. This embodiment would appeal to players wishing to have a relatively quick reveal process.

In an alternate embodiment, the minimum distance could be much greater and require the player to travel distances such a city block or more from their starting actual real-world location. For example, the geographic locations may be real-world locations, such as landmarks, parks, or other types of public areas within a predefined distance of the player's actual real-world location, wherein the geographic locations are identified to the player via the application running on the mobile device. The player may be presented with a choice of which locations they desire to visit, and may be presented with more locations than scratch-spots on the virtual ticket.

In a particularly unique embodiment, the real-world locations are retail establishments, and the player's actual real-world location and the retail establishments are identified to the player via a map provided on the mobile device. This embodiment may be advantageous in that the lottery provider can partner with various retail establishments (e.g. as game sponsors) and patron foot traffic to the retail establishments is increased as a result of the players visiting such locations in order to play their virtual lottery tickets.

In a certain embodiment, play of the virtual lottery tickets may be implemented so as to require a minimum elapsed time between the simulated removal of the scratch-off coating from subsequent scratch spots, such as five minutes, or an hour, depending on the distance between the geographic locations.

The virtual object presented to the player once their location at one of the geographic locations is verified can vary widely within the scope and spirit of the invention. For example, the object may be a tool, such as a coin or token, broom, shovel, or scrapper, which is then used by the player in the virtual simulated removal of the scratch-off coating from the one or more scratch-spots. The player may be required to catch or capture the object, or interact with the object in some manner that requires the player to take action via their mobile device, such as a swipe across the screen or actuation of a button or switch.

As with conventional scratch-off lottery tickets, the outcome of the virtual lottery ticket may be predetermined regardless of an order or number of the scratch-spots uncovered by the player. The outcome can be revealed to the player upon revealing the game indicia from less than all of the scratch-spots.

Alternately, the player's interaction and enjoyment in the game experience may be enhanced by requiring the player to visit a sufficient number of different geographic locations needed to reveal the indicia from all of the scratch-spots before the game outcome is made know.

BRIEF DESCRIPTION OF THE DRAWINGS

A full and enabling disclosure including the best mode of practicing the appended claims and directed to one of ordinary skill in the art is set forth more particularly in the remainder of the specification. The specification makes reference to the appended figures, in which:

DETAILED DESCRIPTION

Figure 1:
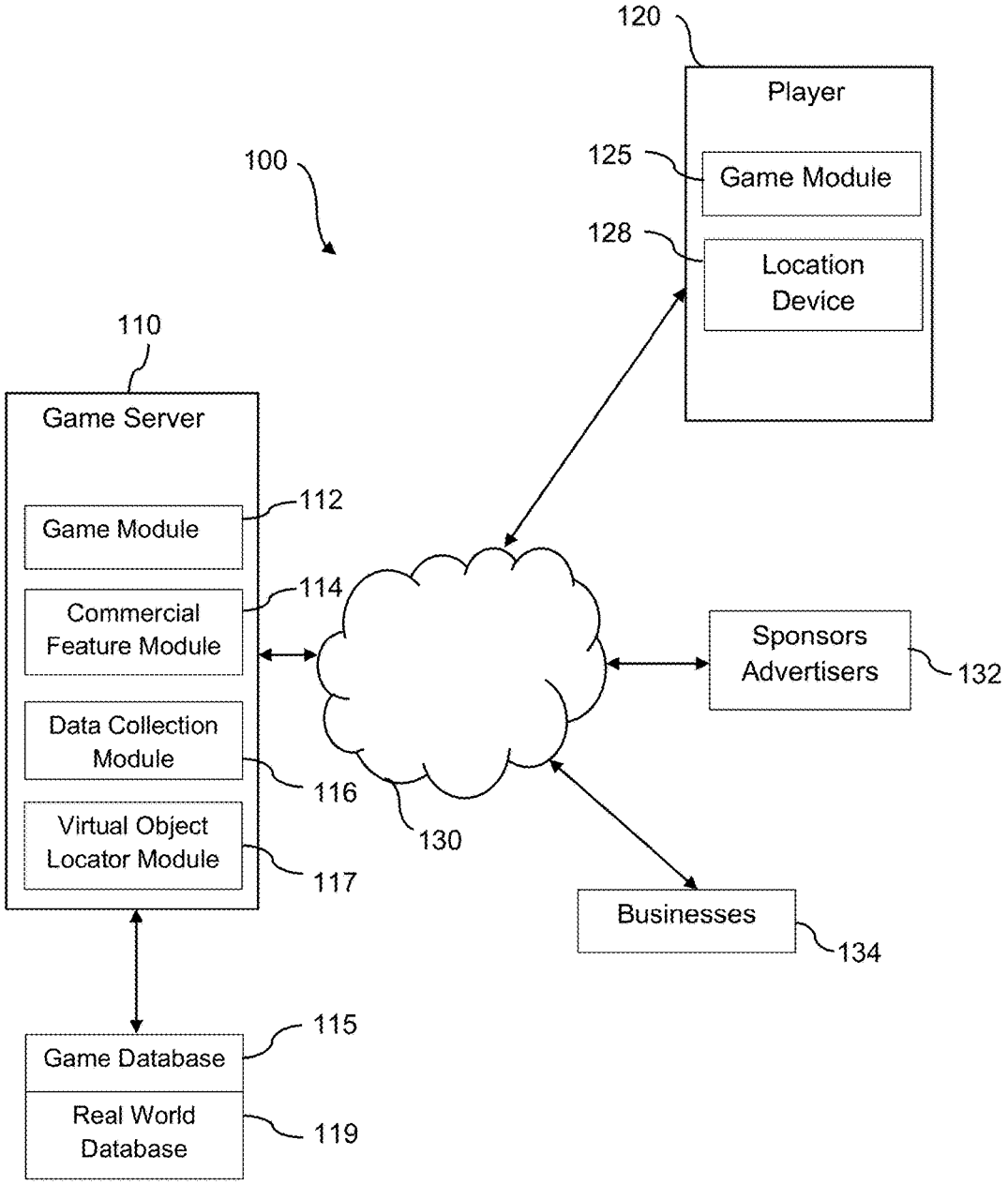
FIG. 1 depicts an exemplary computer-based system for implementing a location-based augmented reality lottery game according to an exemplary embodiment of the present disclosure.

Reference will now be made in detail to various and alternative exemplary embodiments and to the accompanying drawings, with like numerals representing substantially identical structural elements. Each example is provided by way of explanation, and not as a limitation. In fact, it will be apparent to those skilled in the art that modifications and variations can be made without departing from the scope or spirit of the disclosure and claims. For instance, features illustrated or described as part of one embodiment may be used on another embodiment to yield a still further embodiment. Thus, it is intended that the present disclosure includes modifications and variations as come within the scope of the appended claims and their equivalents.

Generally, the present disclosure is directed to a computer-based system and method that introduces augmented reality ("AR") aspects into a player's experience of playing a virtual scratch-off lottery ticket. These features will enhance the player's overall game experience and, in certain embodiments, can also serve to increase patron foot traffic to retail establishments that are authorized for sale of the virtual lottery tickets (or other lottery products), as well as retail establishments that may be sponsors of the lottery games or otherwise affiliated with the lottery provider. The methodology is player location-based wherein AR virtual objects are introduced into the player's real world location as the player moves from one geographic location in the real world to another. The player is invited to interact with these objects in order to acquire a tool that is needed to simulate play of the virtual scratch-off lottery ticket, as discussed below.

The type and presentation of the virtual objects in the player's real world can vary widely and are not a limiting aspect of the invention. For example, in one embodiment, the virtual objects may have a common theme, such as an overall Monopoly™ game theme, wherein the objects are Monopoly™ game pieces or cards introduced into the player's real word environment and used for play of a Monopoly™-themed virtual lottery ticket.

In addition, the manner in which the player interacts with the AR virtual objects may vary widely. For example, the player may be required to capture or collect the virtual objects by taking an action on their mobile device, such as a swipe or tap on the display screen, or use of a virtual weapon or other device to capture or tag the virtual object.

The game server hosts the location-based AR aspects wherein the AR virtual objects are introduced into the player's real world geography, and the players navigate to geographic locations in the real world where the virtual objects are introduced. In particular, the real-world location of players can be monitored or tracked by the game server using, for instance, information from a positioning system (e.g. a GPS system) enabled on the player's mobile device.

The virtual objects can be linked with real-world landmarks or any other publicly accessible location in the real world. For instance, the system and method may include various virtual objects associated with landmarks, retail establishments, or other areas of interest to players in the real world so as to further enhance the player's gaming experience.

In addition, the AR aspects can be linked to real-world commercial establishments to encourage or incentivize commercial activity in the real world related to lottery activity. For example, participating retail establishments other than authorized lottery ticket-sale locations can become sponsors in the game, wherein their respective establishment becomes a tagged geographic location in the game where the AR virtual objects are introduced. The method thus encourages players to also visit these different participating retail establishments during the course of the game. This increased foot traffic in the retail establishments is highly desirable by the retail vendors. In addition, other commercial sponsors, advertisers, businesses, and other entities can become authorized sites in the AR scratch-off lottery ticket game (e.g. for a fee to the lottery authority that implements the lottery ticket games) where the virtual objects are made available.

According to another exemplary embodiment, the AR game aspects can include game features that are linked with data collection activities in the real world. The data collected by the player as a result of performing the data collection activity can be in the form of a photograph, a sound recording, textual information, or other suitable data (e.g. the location of Wi-Fi hotspots, Bluetooth connections, etc.). The collected information can be sent to the game server which can analyze and use the data to improve data associated with the real world aspects of the AR game. For example, a game feature directly linked with data collection activity can include a game objective or task that involves acquiring information about the tagged real world locations where the players acquire the virtual objects, and providing this information as a condition for receipt of the object. For example, a method objective associated with a virtual object at one of the tagged geographic locations can require a player to take a photograph of a particular landmark, art object, store front, or other feature in the real world at the location where the virtual objects are acquired. In return for completing this game objective, the virtual object is enabled on the player's mobile device for use in scratching the virtual lottery ticket.

FIG. 1 illustrates an exemplary computer-implemented location-based gaming system and method 100 configured in accordance with an embodiment of the present disclosure for play of a virtual scratch-off lottery ticket. The location-based gaming system and method 100 provides for the interaction of one or a plurality of lottery game players in a real-world environment enhanced with virtual objects. In particular, the players are directed to various geographic locations in the real world where virtual objects are introduced into the player's travel path. The system 100 can track the player's location in the real world and direct placement of the virtual objects accordingly. Other aspects of the system and method of claim 1 are described in greater detail below.

Figure 2:
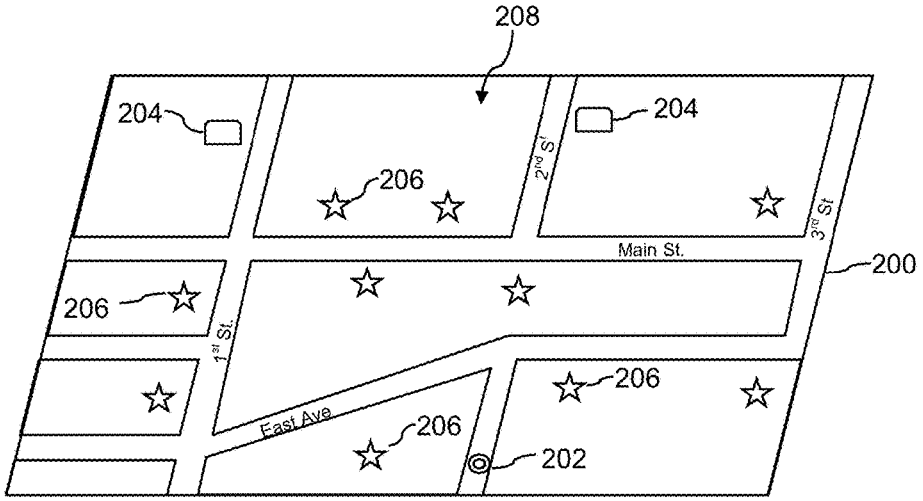
FIG. 2 depicts a real word geography populated with geographic locations where the players can acquire virtual objects.

FIG. 2 depicts a conceptual diagram of a real world 200 defined by a geographic area 208 associated with a town, neighborhood, city, campus, locale, a country, continent, the entire globe, or other real-world geographic area. The geographic area could also be within a building, or even within a room. A player's actual geographic location 202 in the geographic area 208 is noted. As the player 202 moves about in the geographic area 208, the coordinates of the geographic area 208 may change accordingly. For example, the geographic area 208 can be defined as a one square mile area around the player's location 202. A positioning system associated with the player's mobile device (e.g. a GPS system) can be used to track the player's location as the player navigates the range of geographic coordinates in the real world.

As mentioned above, the present method encompasses embodiments of relatively limited movement of the player in the real world, such as within a single building, or even within a single room. This aspect of the method is limited essentially only by the sensitively of the GPS or other locator functionality of the player's mobile device.

Still referring to FIG. 2, aspects of the method involve the player travelling to one or more geographic locations 206 within the geographic area 208. As described above, these locations 206 may be any publicly accessible location, such as a park, building, landmark, and so forth. The locations 206 may be randomly identified by the game server 110 within a pre-defined distance of the player's actual location 202, or may be selected by the game server 110 from a library of stored locations that are within the pre-defined distance from the player's location 202. For example, the locations 206 may correspond to retail establishments that sponsor the lottery ticket game in hopes of increasing patron foot traffic to their respective establishment. The geographic locations 206 may also correspond to authorized lottery ticket establishments 204 where players can purchase lottery tickets (virtual or real), redeem lottery tickets, or conduct other lottery-related activity.

Figure 4:
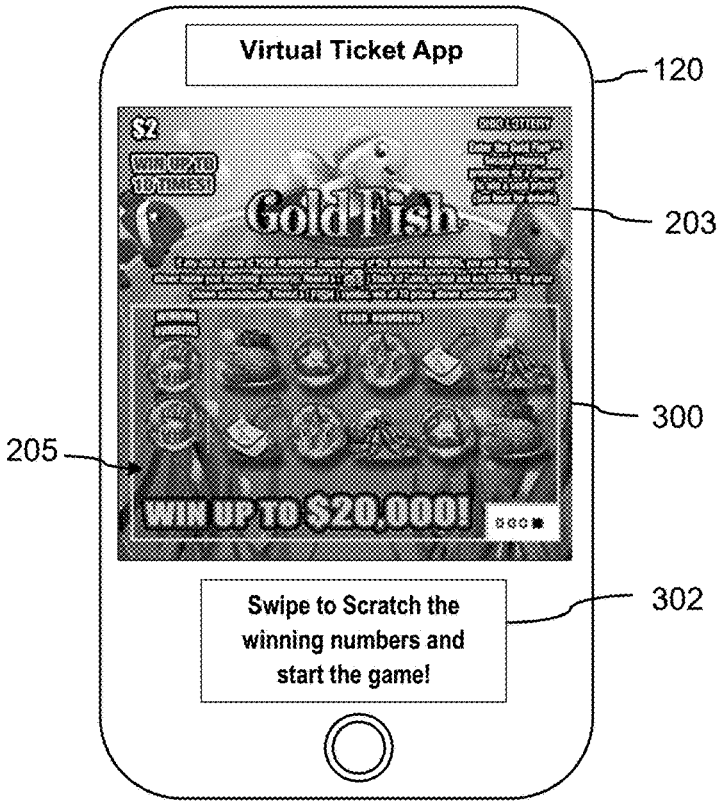
FIG. 4 depicts a player's mobile device with an exemplary virtual scratch-off lottery ticket displayed on the screen.

Referring to FIG. 4, by means of a software application that has been downloaded from the game server 110 (or other authorized source) and is running on the player's mobile device 120, a virtual scratch-off lottery ticket 203 is presented to the player. As with conventional paper scratch-off lottery tickets, the virtual lottery ticket 203 includes any manner of indicia and graphics related to a ticket theme (e.g., "goldfish" theme), and a game play area 205 in which underlying game indicia 209 (FIG. 7) is covered by a scratch-off coating 207. Each covered game indicia on the virtual ticket 203 is referred to as a "scratch-spot" herein. Typically, a certain number of game indicia matches are required for a winning ticket. For the virtual ticket 203, the player simulates scratching of the coating 207 at each of the scratch-spots with a tool 210 corresponding to a virtual object acquired by the player (FIG. 7) to reveal the underlying game indicia and determine the outcome of the virtual lottery ticket 203.

In the embodiment of the virtual scratch-off lottery ticket 203 depicted in FIG. 4, a coating removal feature may be initially enabled for the purposes of allowing the player to simulate removal of the coating 207 from the "winning numbers" scratch-spots, as instructed by the prompt 302. However, in order to scratch and reveal the numbers in the "your numbers" section of the game play area 205, the player must acquire a virtual tool, as discussed below.

The present methodology is not limited by how the player acquires the virtual lottery ticket 203 on their mobile device 120. For example, in one embodiment, the player may purchase a code from one of the authorized lottery ticket sales establishments 204, wherein the code is then used to access the game server 110 for download of the virtual ticket 203 to the mobile device 120. Alternately, such code may be purchased by the player directly from their mobile device 120. The mobile device 120 may be paired with a ticket kiosk at one of the establishments 204 for transfer of the virtual ticket 203. The player may access an established player account with the lottery provider and purchase the virtual ticket 203 via the account. Various means are known and described in the art for providing virtual lottery tickets to mobile devices, and all such means are within the scope and spirit of the invention.

Figure 5:
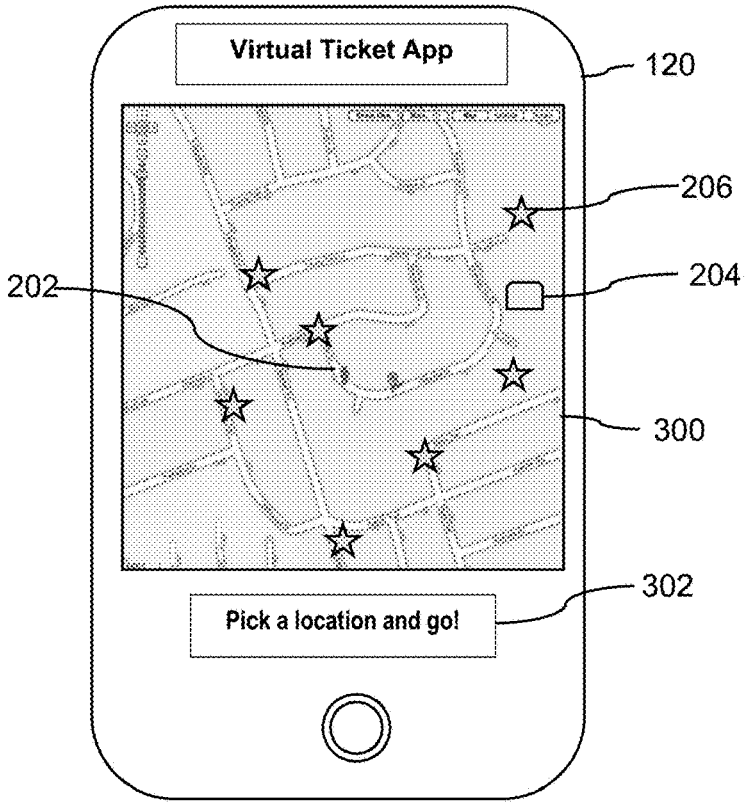
FIG. 5 depicts the player's mobile device with a map displaying the player's location and the geographic locations where the player can acquire a virtual object to play the virtual lottery ticket.

Referring to FIG. 5, via the application running on the mobile device 120, various geographic locations 204, 206 are identified to the player relative to the player's real-world location 202. The player is required to move to one of these geographic locations 204, 206 before the simulated removal of the scratch-off coating 207 is enabled on the mobile device 120 for the remaining scratch-spots in the game play area 205. The player's movement is detected by the mobile device 120 and verified by the real-world location data transmitted to the game server 110. For example, once the player initiates play of the virtual lottery ticket 203, the game server 110 must detect that the player (i.e. the mobile device 120) has moved from one geographic location 206 to another before one or more of the remaining scratch-spots can be revealed to the player.

FIG. 5 depicts multiple geographic locations 204, 206 identified within a predefined distance of the player's actual location 202. In this embodiment, the player may freely choose which of the locations 204, 206 they wish to visit in order to acquire one of the virtual objects 210 (e.g. tool). A prompt 302 may be enabled on the mobile device 120 that allows the player to make their selection of a particular location, wherein the selected location 204, 206 and the player's actual location 202 are displayed on the mobile device screen 300.

Figure 6:
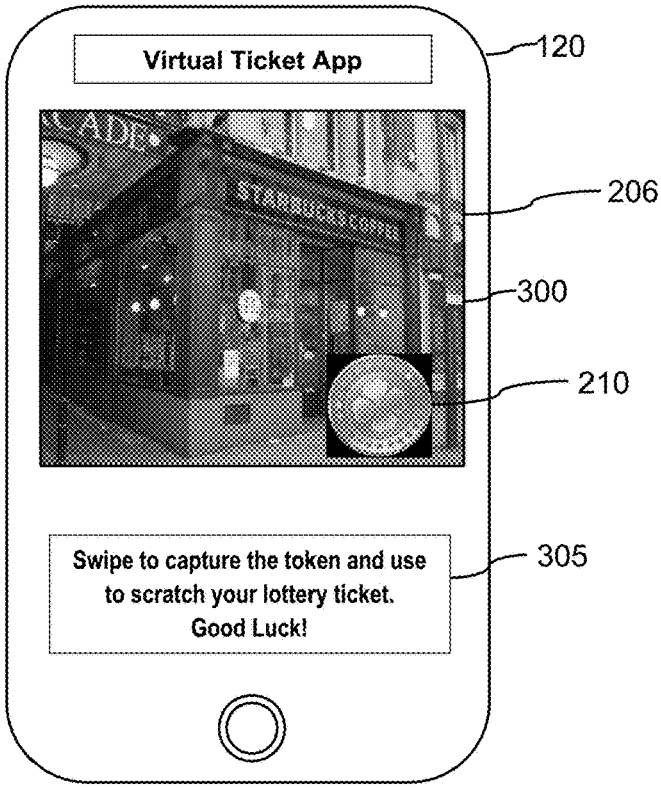
FIG. 6 depicts the player's mobile device with a screen image of one of the geographic locations with an overlaid virtual object.

FIG. 6 conceptually depicts the player moving in the real world to one of the tagged geographic locations 206. Once the player is within a defined distance from the location 206, the game server 110, via the application running on the mobile device 120, overlays a virtual objet 210 on an actual screen image of the location 206 on the player's mobile device 120. For example, referring to FIG. 6, the location 206 is a coffee shop that is viewed by the mobile device's camera such that a real-time image of the coffee shop is displayed on the screen 300. The virtual object 210 is overlaid on the screen image so as to appear to be present at the location 206. At this point, the player is provided with a prompt 305 to interact with the virtual object 210 in some manner, for example by swiping the virtual object 210 on the screen. It should be appreciated that the type of interaction can vary widely within the scope and spirit of the invention. The manner in which the player interacts with the objects 210 can vary depending on the overall game theme. In certain embodiments, a game objective can require players to "capture" or otherwise acquire the virtual objects 210, such as by taking a photograph and/or verifying, obtaining, or capturing other information about the location 206 associated with the virtual object 210. The player may need to take an action on their mobile device 120 in order to acquire the virtual object 210, such as a screen swipe action or button activation to control a virtual weapon or tool used to acquire the virtual object 210.

Figure 7:
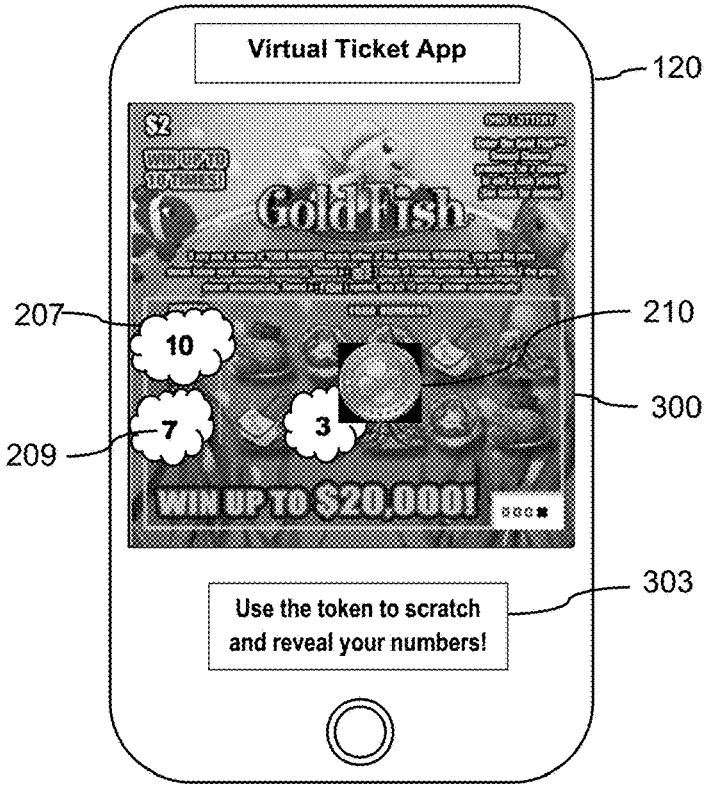
FIG. 7 depicts the player's mobile device and use of the virtual object of FIG. 6 used to simulate scratching off of the scratch-off coating from one of the scratch-spots on the virtual lottery ticket.

Once the virtual object 210 is acquired by the player, it can be used to simulate scratching of the scratch-off coating 207 from one or more of the scratch-spots on the virtual lottery ticket 203, as depicted in FIG. 7 and instructed by the prompt 303. In a particular embodiment, once the object 210 is acquired, it may be placed in a simulated storage location for later retrieval and use in playing the ticket 203. For example, if the virtual lottery ticket has six different scratch-spots and an object 210 can only be used once, the player may accumulate six of the virtual objects 210 before retrieving and using the virtual objects to play the virtual lottery ticket 203.

In an alternate embodiment, the screen 300 may automatically revert to the virtual lottery ticket image of FIG. 4 upon the player acquiring one of the virtual objects 210, wherein the player can immediately use the virtual object 210 to scratch one or more of the scratch-spots in the game play area 205, as depicted in FIG. 7. It is within the scope and spirit of the invention that a single virtual object 210 can be used to scratch from one to all of the scratch-spots.

Play of the virtual lottery tickets 203 may be implemented by the game server 110 such that a minimum distance is required between the geographic locations 204, 206. It should be appreciated that this minimum distance may vary from a few feet (e.g. less than ten feet) to a much greater distance. The minimum distance may be based at least in part on sensitivity of the real world location data received by the game server 110 from the mobile device 120. In other words, if the sensitivity of the mobile device's GPS function is a few feet, then the minimum distance could be defined as this minimum sensitivity distance. Thus, in this embodiment, the player could potentially play the entire virtual ticket 203 within the confines of a single room or other relatively small, defined location. This embodiment would appeal to players wishing to have a relatively quick reveal process for the virtual ticket 203.

In an alternate embodiment, the minimum distance could be much greater and require the player to travel distances such a city block or more from their starting actual real-world location 202. For example, as discussed, the geographic locations 204, 206 may be real-world locations, such as landmarks, parks, or other types of public areas within a predefined distance of the player's actual real-world location 202, wherein the geographic locations 204, 206 are identified to the player via the application running on the mobile device 120, for example on a map as depicted in FIG. 5. The player may be presented with a choice of which locations 204, 206 they desire to visit, and may be presented with more locations than scratch-spots on the virtual ticket 203.

As mentioned above, the real-world locations 206 may be retail establishments, and the player's actual location 202 and the retail establishments 206 are identified to the player via a map provided on the mobile device 120 (FIG. 5). This embodiment may be advantageous in that the lottery provider can partner with various retail establishments (e.g. as game sponsors) and patron foot traffic to the retail establishments 206 is increased as a result of the players visiting such locations in order to play their virtual lottery tickets 203.

In a certain embodiment, play of the virtual lottery tickets 203 may be implemented so as to require a minimum elapsed time between the simulated removal of the scratch-off coating 207 from subsequent scratch spots, such as five minutes, or an hour, depending on the distance between the geographic locations 204, 206.

The virtual object 210 presented to the player once their location at one of the geographic locations 204, 206 is verified can vary widely. For example, the object 210 may be a tool, such as a coin or token as depicted in FIGS. 6 and 7, broom, shovel, or scrapper, which is then used by the player in a virtual simulated removal of the scratch-off coating 207 from the one or more scratch-spots, as in FIG. 7. The player may be required to catch or capture the virtual object 210, or interact with the virtual object 210 in some manner that requires the player to take action via their mobile device, such as a swipe across the screen 300 or actuation of a button or switch on the screen 300.

As with conventional scratch-off lottery tickets, the outcome of the virtual lottery ticket 203 may be predetermined regardless of an order or number of the scratch-spots uncovered by the player. The outcome can be revealed to the player upon revealing the game indicia from less than all of the scratch-spots. Alternately, the player's interaction and enjoyment in the game experience may be enhanced by requiring the player to visit a sufficient number of different geographic locations 204, 206 needed to reveal the indicia from all of the scratch-spots before the game outcome is made know.

Referring back FIG. 1, the system 100 can include the lottery provider server architecture, where the game server 110 communicates with one or more players (mobile devices) 120 over a network 130. Although one player device 120 is illustrated, it should be understood that any number of players 120 can be connected to the game server 110 over the network 130. The server 110 can host a universal gaming module 112 that controls aspects of the location-based game components for all players 120 and receives and processes each player's input in the location based game. On the player-side, each mobile device 120 can include a gaming module 125 that operates as a gaming application so as to provide the player with an interface to the system 100. The game server 110 transmits game data over the network 130 to the mobile device 120 for use by the gaming module 125 to provide local versions of the game to players at locations remote from the game server 110. The server 110 can include a network interface for providing communications over the network 130. A network interface can include any suitable components for interfacing with one more networks, including for example, transmitters, receivers, ports, controllers, antennas, or other suitable components.

It will be appreciated that the term "module" refers to computer logic utilized to provide desired functionality. Thus, a module can be implemented in hardware, firmware and/or software controlling a general purpose processor. In one embodiment, the modules are program code files stored on the storage device, loaded into memory and executed by a processor or can be provided from computer program products, for example computer executable instructions, that are stored in a tangible computer-readable storage medium such as RAM hard disk or optical or magnetic media.

The game server 110 can be any computing device and can include one or more processors and one or more computer-readable media. The computer-readable media can store instructions which cause the processor to perform operations.

The game server 110 can include or can be in communication with a game database 115. The game database 115 stores game data used in the location-based game to be provided to the players 120 over the network 130. The game data can include: data associated with players of the location-based game (e.g. player information, player experience level, player currency, current player positions in the virtual world/real world, player energy level, player preferences, team information, faction information, etc.); data associated with game objectives (e.g. data associated with current game objectives, status of game objectives, past game objectives, future game objectives, desired game objectives, etc.); data associated virtual objects in the real world (e.g. positions of virtual elements, types of virtual elements, game objectives associated with virtual elements; corresponding actual world position information for virtual elements; behavior of virtual elements, relevance of virtual elements etc.); data associated with real world objects, landmarks, positions linked to virtual world elements (e.g. location of real world objects/landmarks, description of real world objects/landmarks, relevance of virtual elements linked to real world objects, etc.); data associated with player actions/input (e.g. current player positions, past player positions, player moves, player input, player queries, player communications, etc.); and any other data used, related to, or obtained during implementation of the location-based AR lottery game. The game data stored in the game database 115 can be populated either offline or in real time by system administrators and/or by data received from users/players of the system 100, such as from one or more player mobile devices 120 over the network 130.

The game server 110 can be configured to receive requests for game data from the player mobile devices and to respond to those requests via the network 130. For instance, the game server 110 can encode game data in one or more data files and provide the data files to the device 120. In addition, the game server 110 can be configured to receive game data (e.g. player positions, player actions, player input, etc.) from the devices 120 via the network 130. For instance, the devices 120 can be configured to periodically send player input and other updates to the game server 110, which the game server 110 uses to update game data in the game database 115 to reflect any and all changed conditions for the game.

As depicted, the game server 110 can include a universal game module 112. The universal game module 112 hosts the location-based game for all players and acts as the authoritative source for the current status of the location-based game for all players. The universal game module 112 receives game data from player devices 120 (e.g. player input, player position, player actions, landmark information, etc.) and incorporates the game data received into the overall location-based game for all players of the location-based game. The universal game module 112 can also manage the delivery of game data to the player devices over the network 130.

The game server 110 can further include a commercial feature module 114 that can be separate from or a part of the universal game module 112. The commercial game feature module 114 can manage the inclusion of various game features that are linked with a commercial activity in the real world. For instance, the commercial game feature module 114 can receive requests from sponsors/advertisers 132, businesses 134, or other entities over network 130 (via a network interface) to include game features linked with commercial activity in the real world game. The commercial game feature module 114 can then arrange for the inclusion of these game features in the parallel reality game. Examples of such commercial features include the purchase of merchandise from a sponsor or in a retail location at a discount, or to receive bonus points in a secondary game, or any activity that incentivizes players to purchase goods from a particular sponsor to visit a particular location.

The game server 110 can further include a data collection module 116 that can be separate from or a part of the universal game module 112. The data collection module 116 can manage the inclusion of various game features within the real world game that are linked with a data collection activity in the real world. For instance, the data collection module 116 can modify game data stored in the game database 115 to include game features linked with data collection activity in the real world game. The data collection module 116 can also analyze data collected by players pursuant to the data collection activity and provide the data for access by various platforms.

Other modules can be used with the game server 110. Any number of modules can be programmed or otherwise configured to carry out the server-side functionality described herein. In addition, the various components on the server-side can be rearranged. For instance, the game database 115 can be integrated into the game server 110. Other configurations will be apparent in light of this disclosure and the present disclosure is not intended to be limited to any particular configuration.

The player's mobile device 120 can be any portable computing device that can be used by a player to interface with the gaming system 100. For instance, the device 120 can be a wireless device, a personal digital assistant (PDA), portable gaming device, cellular phone, smart phone, tablet, navigation system, handheld GPS system, wearable computing device, a display having one or more processors, or other such device. In short, the player mobile device 120 can be any computer-device or system that can execute a gaming module 125 to allow a player to interact with the game system 100.

The player mobile device 120 can include one or more processors and one or more computer-readable media. The computer-readable media can store instructions which cause the processor to perform operations. The device 120 can include various input/output devices for providing and receiving information from a player, such as a display screen, touch screen, touch pad, data entry keys, speakers, and/or a microphone suitable for voice recognition. The device 120 can further include a network interface for providing communications over the network 130. A network interface can include any suitable components for interfacing with one more networks, including for example, transmitters, receivers, ports, controllers, antennas, or other suitable components.

The gaming module 125 executed by the player mobile device 120 provides an interface between a player and the location-based aspects implemented by the game system 100. The gaming module 125 can present a user interface on a display device associated with the mobile device 120 that displays a real world environment associated with the game and a virtual element(s) overlay. The interface allows the player to interact with the overlaid virtual elements to perform various game objectives. The gaming module 125 can access game data received from the game server 110 to provide an accurate representation of the game to the user. The gaming module 125 can receive and process player input and provide updates to the game server 110 over the network 130.

As mentioned, the gaming system 100 is for a location-based game, and the player mobile device 120 is preferably a portable computing device, such as a smartphone or other portable device, that can be easily carried or otherwise transported with a player. A player can interact with the virtual elements simply by carrying or transporting the mobile device 120 to locations in the real world where the virtual elements are enabled. In this regard, the player mobile device 120 can include a location device 128 that monitors the position of a player during game play. The location device 128 can be any device or circuitry for monitoring the position of the mobile device 120. For example, the location device 128 can determine actual or relative position by using a satellite navigation positioning system (e.g. a GPS system, a Galileo positioning system, the Global Navigation satellite system (GLONASS), the Bei-Dou Satellite Navigation and Positioning system), an inertial navigation system, a dead reckoning system, based on IP address, by using triangulation and/or proximity to cellular towers or Wi-Fi hotspots, and/or other suitable techniques for determining position.

As the player moves around with the mobile device 120 in the real world, the location device 128 tracks the position of the player and provides the player position information to the gaming module 125, which continuously or periodically updates the player's actual position in the real world. Based on this real world position, the gaming module 112 identifies real world locations within a defined proximity where the virtual objects are located and transmits such locations to the game module 125, which displays or otherwise notifies the player of such locations, for example by displaying the locations on a real world map provided on the mobile device's screen. In certain embodiments, location information associated with a player is utilized only if permission is granted after the player has been notified that location information of the player is to be accessed and how the location information is to be utilized in the context of the game. In addition, any location information associated with players will be stored and maintained in a manner to protect player privacy.

The network 130 can be any type of communications network, such as a local area network (e.g. intranet), wide area network (e.g. Internet), or some combination thereof. The network can also include a direct connection between a player mobile device 120 and the game server 110. In general, communication between the game server 110 and player mobile device 120 can be carried via a network interface using any type of wired and/or wireless connection, using a variety of communication protocols (e.g. TCP/IP, HTTP, SMTP, FTP), encodings or formats (e.g. HTML, XML, JSON), and/or protection schemes (e.g. VPN, secure HTTP, SSL).

The technology discussed herein makes reference to servers, databases, software applications, and other computer-based systems, as well as actions taken and information sent to and from such systems. One of ordinary skill in the art will recognize that the inherent flexibility of computer-based systems allows for a great variety of possible configurations, combinations, and divisions of tasks and functionality between and among components. For instance, server processes discussed herein may be implemented using a single server or multiple servers working in combination. Databases and applications may be implemented on a single system or distributed across multiple systems. Distributed components may operate sequentially or in parallel.

Figure 3:
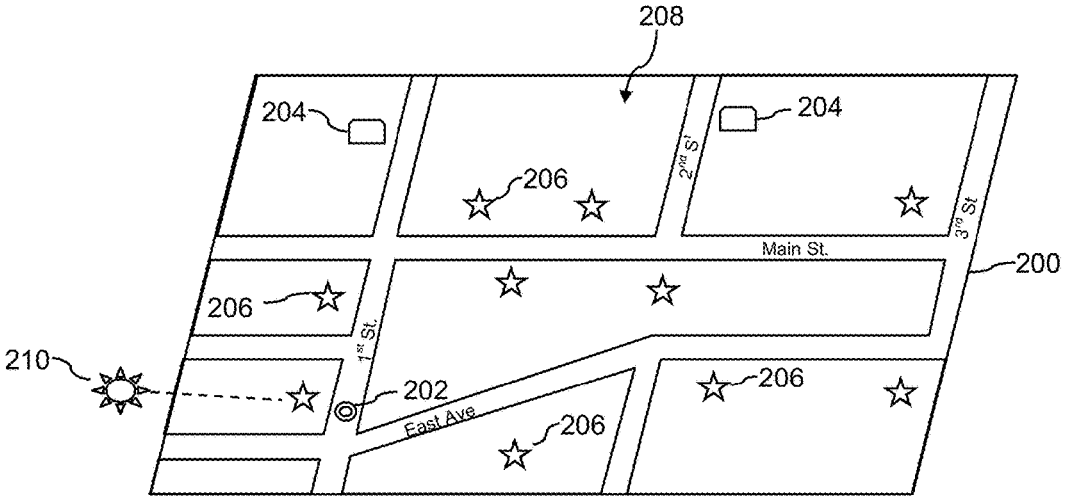
FIG. 3 depicts the real word geography of FIG. 2 with the player's location at one of the geographic locations.

Referring to FIGS. 2 and 3, for locating the virtual objects 210 in the real world geography 208, the game server 110 accesses data associated with one or more real world conditions. For instance, an object locator module 117 implemented by the game server 110 can access data associated with one or more real world conditions stored in the game database 115 (which may include a real world condition database 119). Alternatively, the locator module 114 can access one or more different data sources providing real world condition data, such as a third party data service or other data source. Exemplary data associated with one or more real world conditions accessed by the game server 110 can include the aggregate locations of individuals (e.g. players) in the real world; local time data; local data providing locations of cultural value, recreational value, historical value, commercial value, or other value; map data providing the locations of roads, highways, and waterways, public property, private property, and other information;

current and past locations of individual players; hazard data; weather data; event calendar data; and other suitable data.

The game server 110 analyzes the data associated with the one or more real world conditions to determine a location for placement of an object 210 at a location 206 based on the data associated with the one or more real world conditions. The locator module 114 can determine locations for placement of any type of virtual element 210 used in the AR game, such as a virtual item, virtual energy, or other virtual element 210 that forms a part of the AR game aspects. Exemplary analysis techniques for analyzing data associated with real world conditions to determine a location for placement of virtual elements in the virtual world will be discussed in detail below.

The game server 110 can modify game data stored in, for instance, the game database 115 and/or transmitted to player mobile devices 120 over the network 130 to locate one or more virtual objects 210 at locations 206 determined based on the data associated with real world conditions. The game server 110 can send files encoded with game data to the mobile devices 120 over the network 130, wherein the game data can include data locating virtual elements 206 in the player's real world.

The player mobile device 120 accesses the game data transmitted by the game server 110 and then presents the virtual objects 210, for example by displaying a real world picture of the player's location 202 acquired by the device's camera on a display screen 300 with one or more of the virtual objects 210 overlaid on the real world picture. Other suitable interfaces can be provided to present the virtual objects 210 to the player, such as audio, vibratory, or other interfaces so that a player can interact with the virtual objects 210 without having to look at the display screen 300 of the device 120.

The player mobile device 120 receives data indicative of player actions in the AR game, such as data indicative of the player's movement as determined by the location device 128, and provides this data to the game server 110. The game server receives the data and updates the game data for the AR game based on the received data. For example, the received data may indicate that the player has moved a predefined distance away from the location 206, wherein the virtual object 210 is disabled or removed from the screen until the player returns or moves on to another location 206.

As discussed, the virtual objects 210 may be located at locations 206 corresponding to the predicted path of travel of the player so that the game encourages patron interaction with such locations 206. For example, data associated with current and past player position for a particular player is accessed by the locator module 114 from the game database 115 which stores position information associated with players of the AR game. The locator module 114 can access map data providing the locations of traversable paths proximate the player's current position, and can analyze current player position and direction, past player position and direction, the locations of traversable paths proximate the players and predict a future path for the player. The locator module 114 can then locate a virtual object 210 at one or more of the locations 204, 206 along the predicted player path.

The material particularly shown and described above is not meant to be limiting, but instead serves to show and teach various exemplary implementations of the present subject matter. As set forth in the attached claims, the scope of the present invention includes both combinations and sub-combinations of various features discussed herein, along with such variations and modifications as would occur to a person of skill in the art.

What is claimed is:

1. A method for implementing a virtual and augmented reality scratch-off lottery ticket, comprising:

configuring a game server for communication with a player's mobile device, the game server receiving real-world location data from the mobile device;

downloading a virtual scratch-off lottery ticket from the game server to the mobile device, wherein the player simulates removal of a scratch-off coating from a plurality of scratch spots on the lottery ticket to reveal underlying game indicia that indicates a winning or losing outcome of the virtual lottery ticket;

via an application running on the mobile device, requiring the player to move to a geographic location in the real world before the simulated removal of the scratch-off coating is enabled on the mobile device;

when the player is at the geographic location, the game server and running application overlaying the virtual objet on a screen image on the mobile device;

with the application running on the mobile device, providing for the player to interact with the virtual object in a manner to acquire the virtual object; and once acquired by the player, configuring the virtual scratch-off lottery ticket with the virtual object that must be used by the player to simulate removal of the scratch-off coating from at least one of the scratch spots on the virtual lottery ticket to reveal the underlying game data.

2. The method according to claim 1, wherein the virtual object is stored for retrieval by the player at a time of their choosing for use to simulate scratching of the scratch-off coating from one of the scratch-spots on the virtual lottery ticket.

3. The method according to claim 1, wherein the player is required to move to an additional geographic location and interact with an additional virtual object for each scratch spot on the lottery ticket.

4. The method according to claim 3, wherein a minimum distance between the geographic locations is defined by the game server.

5. The method according to claim 4, wherein the minimum distance is based at least in part on sensitivity of the real world location data received by the game server from the mobile device.

6. The method according to claim 4, wherein a minimum elapsed time between the simulated removal of the scratch-off coating from subsequent scratch spots is required by the game server.

7. The method according to claim 3, wherein the geographic locations are real-world locations within a predefined distance of the player's actual real-world location, the geographic locations identified to the player via the application running on the mobile device.

8. The method according to claim 7, wherein the real-world locations are retail establishments, the player's actual location and the retail establishments identified to the player via a map provided on the mobile device.

9. The method according to claim 1, wherein the virtual object is a tool used in the simulated removal of the scratch-off coating.

10. The method according to claim 1, wherein the outcome of the lottery ticket is predetermined regardless of an order or number of the scratch-spots uncovered by the player.

11. The method according to claim 10, wherein all of the scratch-spots must be uncovered by the player to determine the outcome of the lottery ticket.

* * * * *